US007105787B2

(12) United States Patent
Clemen, Jr.

(10) Patent No.: US 7,105,787 B2
(45) Date of Patent: Sep. 12, 2006

(54) REVERBERATING ADAPTIVE MICROWAVE-STIRRED EXPOSURE SYSTEM

(75) Inventor: Mark J. Clemen, Jr., Bremertion, WA (US)

(73) Assignee: Fiore Industries, Inc., Albuquerque, NM (US)

( * ) Notice: Subject to any disclaimer, the term of this patent is extended or adjusted under 35 U.S.C. 154(b) by 0 days.

(21) Appl. No.: 10/697,072

(22) Filed: Oct. 29, 2003

(65) Prior Publication Data

US 2004/0134904 A1 Jul. 15, 2004

Related U.S. Application Data

(60) Provisional application No. 60/421,853, filed on Oct. 29, 2002.

(51) Int. Cl.
*H05B 6/68* (2006.01)

(52) U.S. Cl. ..... 219/702; 219/709; 219/715; 219/751; 324/636; 333/231

(58) Field of Classification Search ..... 219/702–717, 219/745–751; 324/633–646; 333/227–233
See application file for complete search history.

(56) References Cited

U.S. PATENT DOCUMENTS

| | | | | |
|---|---|---|---|---|
| 5,417,494 | A * | 5/1995 | Kempa et al. | 219/711 |
| 5,521,360 | A * | 5/1996 | Johnson et al. | 219/709 |
| 5,530,412 | A * | 6/1996 | Goldblum | 324/633 |
| 6,403,939 | B1 * | 6/2002 | Fagrell | 219/709 |

* cited by examiner

*Primary Examiner*—Philip H. Leung
(74) *Attorney, Agent, or Firm*—Deborah A. Peacock; Philip D. Askenazy; Peacock Myers, P.C.

(57) ABSTRACT

A method and apparatus for adaptively maintaining the power-frequency spectrum in a reverberation chamber. The invention is thus capable of maintaining a relatively constant power-frequency spectrum in the chamber even when a device under examination is placed into the chamber which exhibits selective frequency absorption and or directional frequency absorption. The object disposed within the chamber need not necessarily be a device under examination. Rather, the present invention can also adaptively maintain a relatively constant power-frequency spectrum when heating any material disposed within a electromagnetic wave chamber.

16 Claims, 2 Drawing Sheets

REVERBERATING ADAPTIVE MICROWAVE-STIRRED EXPOSURE SYSTEM

This application claims the benefit of the filing of U.S. Provisional Patent Application Ser. No. 60/421,853, entitled "Electronic Reverberation Chamber Mode-stir with Feedback Control", filed on Oct. 29, 2002, and the specification thereof is incorporated herein by reference.

BACKGROUND OF THE INVENTION

1. Field of the Invention (Technical Field)

The present invention relates to a method of improving the uniformity of standardized microwave exposures while maximizing the exposure field level for a given Radio Frequency (RF) input power. The present invention is an extension of previous methods in that it is applicable to devices and materials that exhibit frequency-selective microwave absorption, actively adjusting the shielded chamber excitation to maintain a uniform average microwave exposure field.

2. Description of Related Art

RF microwave exposures can be performed in many ways. It can be performed in the free field, often the most realistic situation. Of course, the escape of microwave radiation to the surroundings is guaranteed. Furthermore, high power sources are often needed to assure sufficient electric field at a Device Under Exposure (DUE). Anechoic chambers are used to obviate the first problem: the microwave radiation is contained and absorbed by special wall linings inside of a shielded cavity. The problem still exists that high power sources are necessary for a wide range of exposures, that the direction of incidence of the microwave radiation is from one direction at a time only, and depending on the source, exposures are performed in one electric polarization at a time. RF testing or industrial microwave exposures then become an onerous procedure, onerous especially if only high-level, global results are required.

Reverberation chambers lack the absorbing wall linings that anechoic chamber incorporate. The microwave radiation "fills" the shielded cavity, bouncing back and forth between the walls. The multiplication of the electric field strength in the cavity "hot spots" can be enormous: this is how a microwave oven works. Much lower power sources are required. Furthermore, testing is performed at all angles, directions of incidence, and all polarizations as the radiation bounces around the cavity. The benefits are large for production line microwave exposures: the weakness, however, is equally large. The weakness associated with reverberation chambers is that they have electric cold spots and hot spots interspersed throughout the volume, depending on how the electric fields add and cancel as they bounce around. The position of these can dramatically affect the electric field level to which the DUE is exposed. Worse, the positions of the hot and cold spots depend on the test frequency, as well as the location and orientation of the DUE.

Two solutions have been implemented to mitigate these disadvantages in reverberation chambers. The traditional solution is the one that has received the greatest investment in development; it is known as "mechanical mode-stir". By incorporating a significant moving mechanical feature inside the chamber, the positions of the hot-spots and cold-spots can be shifted back and forth, up and down, so that on average the electric field is the same everywhere inside the chamber. Typical mode-stir devices are giant fans, whose blades rotate to change the effective boundary location of the wall, and rotate rapidly in an attempt to minimize the time that the electric field hot spots exist in any one location. The average shifting times in a good mechanical mode-stir equipped device are in the milliseconds. Despite the fact that modern electronics respond to time scales up to one million times faster than this, mechanical mode-stir has been developed to provide a reliable, well-defined and reasonably inexpensive method of testing.

The competing technology in reverberation chamber microwave exposures is electronic mode-stir. With this background, electronic mode-stir is simple to qualitatively define. Since the positions of the chamber hot-spots and cold-spots depend on the excitation frequency, then by rapidly changing the excitation frequency over a range of values, then these hot-spots and cold-spots can essentially "blur" together. This is accomplished in practice by either sweeping the excitation up or down in frequency, or, by randomly shifting from one frequency or phase to another. The latter method is often referred to as noise excitation.

Noise excitation is particularly simple to implement. A noise signal is combined with a microwave center frequency signal at a balanced mixer, and the result is a fairly uniform band of random frequencies generated above and below that center frequency. With clever system design, this results in a reverberation chamber having an average electric field value everywhere in the chamber, regardless of the center frequency or of the position of the DUE in the chamber.

It is informative to define electronic mode-stir more quantitatively. For a rectangular cavity with perfectly conducting walls, the frequencies at which resonances can exist is given by equation 1, wherein (l, m, n) is any set of non-negative integers, except (0, 0, 0), (a, b, d) are the dimensions of the rectangular cavity, and c is the speed of light.

$$f_{lmn} = \frac{c}{2}\sqrt{\left(\frac{l}{a}\right)^2 + \left(\frac{m}{b}\right)^2 + \left(\frac{n}{d}\right)^2}. \qquad \text{Equation 1}$$

Each mode of the chamber then can be designated by the integer triple (l, m, n). If a is the largest chamber dimension (they may all be equal), then the base frequency of the rectangular chamber corresponds to the mode (1, 0, 0). Below this the chamber is electrically small compared to the excitation frequency, and cannot sustain any resonance at all. As l, m, and n increase and became large, then the frequencies $f_{lmn}$ become closer together and eventually form a nearly continuous variable. The result is often called an "over-moded" chamber. The nearly continuous spectrum of chamber excitation frequencies is denoted simply by 'f'.

At large l, m, and n, the total number of all modes excited up to such a high frequency, N, can be closely approximated by Equation 2:

$$N \approx lmn \qquad \text{Equation 2.}$$

In this high-frequency approximation, Equation 3 shows that for some constant factor γ, the number of modes ΔN within some frequency interval Δf centered at a frequency f is:

$$\Delta N = \frac{24V}{\gamma c^3} f^2 \Delta f. \qquad \text{Equation 3}$$

One can see an important result; the number of modes contained in some frequency range is proportional to the volume, and to the square of the frequency. Doubling the volume doubles the number of modes in a frequency range. Double the frequency quadruples the mode structure density. The more modes excited, the better the mode-mixing and the more uniform the microwave exposure inside of the reverberation chamber. In electronic mode stir excitation, one can see that bigger test chambers and higher frequencies are better.

A rule-of-thumb that has often been quoted in electronic mode-stir exposures is that for a given chamber volume and test frequency, the excitation bandwidth should be sufficient to excite at least 60 modes in an over-moded chamber for a statistically significant electric field uniformity. This may arrive at average electric field uniformity variations of about 1 dB. Since more is better, more than a hundred modes should be excited to achieve better than 10% maximum field variation.

Despite the promise of electronic mode-stir to establish rapid electronic testing on electronic time-scales, the concept still has enormous weaknesses. The first weakness is often overlooked, yet very important in RF testing. The typical implementation of electronic mode-stir generation, using a noise generator and a balanced mixer, results in a randomly-generated set of frequencies about the center frequency with the exclusion of the center frequency itself.

The second weakness of traditional electronic mode-stir exposure is far worse. Devices under examination that actually do have significant microwave frequency vulnerabilities will, almost by definition, have correspondingly significant energy absorption at those frequencies. This is a disaster for electronic mode-stir testing. DUEs with significant frequency-dependent microwave absorption therefore change the mode-structure of the excited chamber, and therefore change the average electric field incident upon themselves. Simply put, microwave-absorbing materials or devices exposed in electronic mode-stir chambers change the conditions of their own exposure. In searching for methods of standard industrial microwave exposure, electronic mode-stir is often seen as the first method to discard for this reason alone. There is thus a present need for a method of improving the uniformity of standardized microwave exposures while maximizing the exposure field level for a given RF input power.

BRIEF SUMMARY OF THE INVENTION

The present invention is directed to a reverberating adaptive electromagnetic wave-stirred exposure apparatus and method, and in particular to a microwave-stirred exposure apparatus and method. The invention comprises a microwave chamber, one or more power amplifiers, a microwave generator, and one or more microwave sensors. The sensors reside within the microwave chamber and readings obtained from them are used to control the amplifiers and/or generator so as to create an adaptive system.

The reverberating adaptive microwave-stirred exposure apparatus preferably has sensors that detect selective absorption of microwave frequencies by a device under examination which is placed within the chamber. The apparatus is preferably automatically adjusted to compensate for any selective absorption that is exhibited by the device under examination.

The reverberating adaptive microwave-stirred exposure apparatus preferably has one or more microwave feeds into the chamber. The feeds are preferably x-axis, y-axis, and z-axis feeds.

The chamber of the reverberating adaptive microwave-stirred exposure apparatus is preferably a microwave reverberation chamber. The reverberating adaptive microwave-stirred exposure apparatus preferably also has a processor for adjusting the generator. The processor preferably first analyzes the power spectrum before adjusting the generator. The processor preferably uses Fast Fourier Transforms (FFT) to analyze the power spectrum.

The processor preferably first analyzes readings obtained from the sensors and then adjusts the output amplitude of one or more amplifiers such that readings obtained from the sensors are adaptively adjusted such that they remain substantially similar in the magnitude of their readings.

Adjusting the power amplifiers is preferably performed quickly and repetitiously so as to create an adaptive system.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

It is a primary object of the present invention to provide a reverberating adaptive microwave-stirred exposure apparatus and method that adaptively adjusts the frequency and/or the amplitude of the microwaves that are injected into the chamber.

It is primary advantage of the present invention that a relatively even magnitude of microwave energy can be maintained within the chamber for each direction in which the microwaves are injected.

Another advantage of the present invention is that it enables a user to minimize discrepancies within the frequencies injected in the chamber.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is directed to a method and apparatus for adaptively microwave-stirring a reverberation chamber, and more particularly to a method and apparatus for adaptively microwave-stirring a reverberation chamber by a processor analyzing the signal produced from one or more sensors disposed within the chamber, and, based on these signals, adjusting the frequency generator and or power amplifiers.

The term "microwave" is used throughout the specification and claims as the preferred embodiment of the invention. However, other electromagnetic waves are useful in accordance with the invention, and it is intended that the word "microwave" include such embodiments. The terms "generator" and "synthesizer" are used interchangeably throughout the specification and claims of this application and are intended to mean any and all devices capable of outputting an electrical signal at selected frequencies. The term "processor" is used throughout the claims and specification to maintain clarity. It is, however, intended to include computers as well as microcontrollers as will be readily recognized by those skilled in the art. The terms "Device Under Examination" and "DUE" as used throughout the specification and claims are intended to mean anything that is placed into a microwave chamber. Thus, the item, material, object, device, or any combination thereof so disposed within the chamber need not be "under examination". Rather the item, material, object, device, or any combination thereof can be placed into the chamber for the purposes of heating, testing, or other industrial processing. The term "stirring" as used throughout the specification and claims is intended to include stirring, mixing, and the like.

Figure 1:
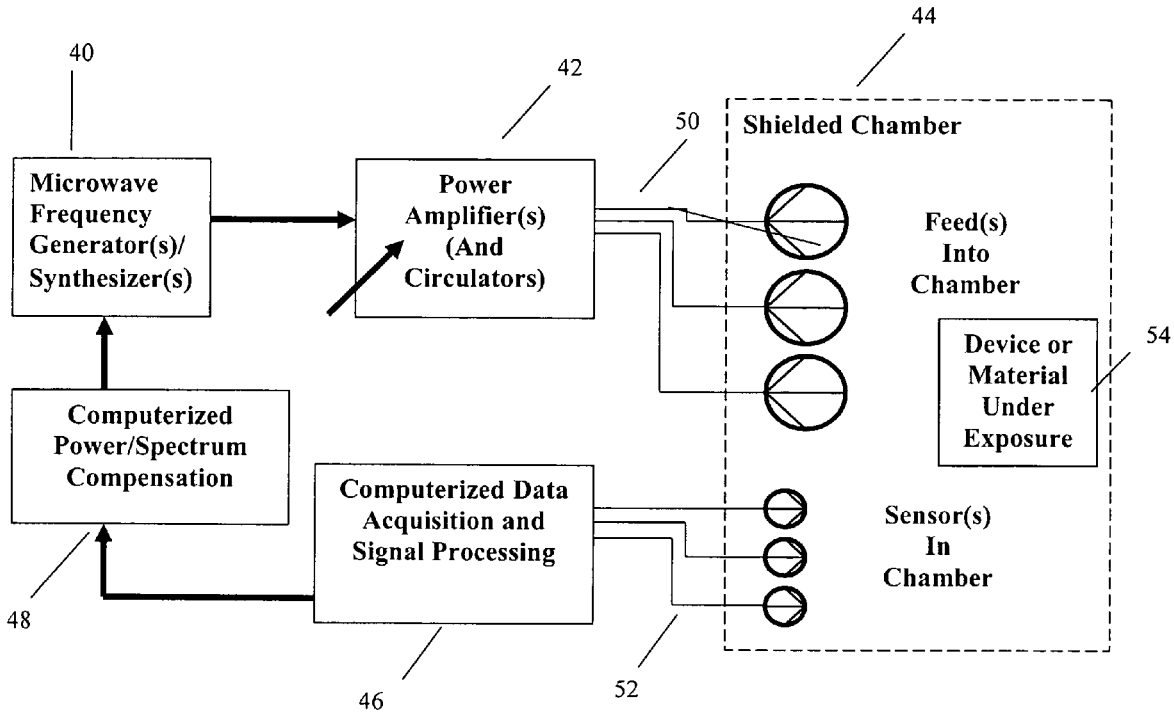
FIG. 1 is a block diagram showing the interrelationship of major elements of the present invention.

The reverberating adaptive microwave-stirred exposure system (RAMSES) of the present invention is shown in FIG. 1. The seemingly circular process begins with microwave frequency generation 40, initially chosen to achieve a desired amount of electromagnetic (EM) field uniformity via electronic mode-stirring in chamber 44. Any number of commonly available generators and or synthesizers can be used in accordance with the present invention. This signal is then sent to power amplifier 42 and then into chamber 44. Any power amplifier, capable of amplifying the signal that can produce desirable results can be used. One or more sensors in chamber 44 then detect the resulting EM field power spectrum in chamber 44. Any number of commonly available sensors that can be made to produce desirable results can be used. The signals from one or more sensors are acquired, digitized and analyzed by processor 46. Automatic feedback based on this information then goes back to microwave frequency generator 40. Should a range of frequencies injected into chamber show selective absorption anywhere in this range, processor 46 can detect it and compensate accordingly 48.

Frequency-dependent microwave absorption inside of chamber 44 may be directional. The present invention can easily be scaled to compensate for this. To do so, multiple chamber feeds 50, preferably three, as shown in FIG. 1, are orientated in different directions within chamber 44. While feeds 50 can be placed in any direction within chamber 44 with respect to one another and still produce desirable results, it is preferable that these feeds 50 be disposed such that one is directed in the x-axis of chamber 44, one in the y-axis and one in the z-axis. A separate processor-controlled power amplifier 42 preferably drives each feed 50. Each power amplifier 42 may be provided with protection against energy being fed-back into it from the other two amplifiers, such as with microwave circulator 42.

For power up to a few hundred watts, power injected into the chamber is preferably achieved through the use of a wideband antenna. The wideband antenna is preferably a log-periodic wideband antenna. The present invention may also produce desirable results through the use of a wideband antenna as developed by Fiore Industries Inc., of Albuquerque, N. Mex., based upon a terminated or unterminated open transmission line placed in a corner or along an edge of the chamber.

Three sensors 52 then detect the microwave EM fields in each of the three directions at a suitable point in chamber 44, and these acquired signals are processed 46 separately. Processor 46 is then able to decide if DUE 54 is causing directional-frequency-dependent absorption. The present invention can then modify the power spectrum of the excitation signals by increasing the amplitude outputted by any of the amplifiers. Modification of the power spectrum fed into chamber 44 can also take place with the frequency spectrum being modified at corresponding microwave generator 40, and the relative power being set at the appropriate amplifier 42.

Figure 2A:
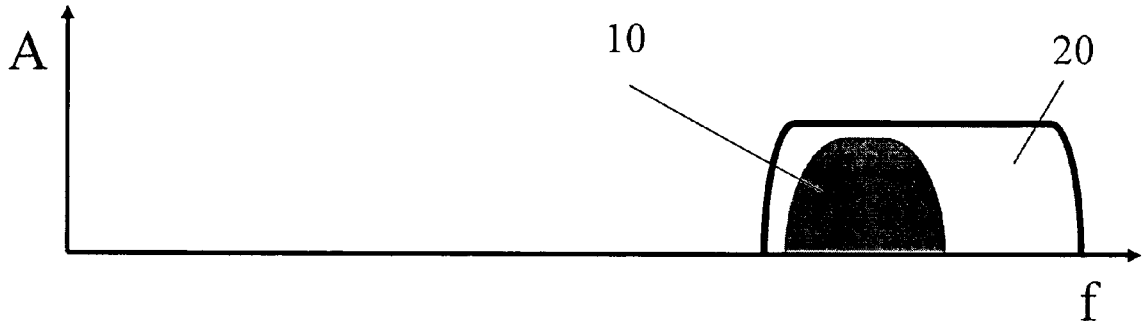
FIG. 2A is a chart showing an example of an absorption occurring over a frequency range.
Figure 2B:
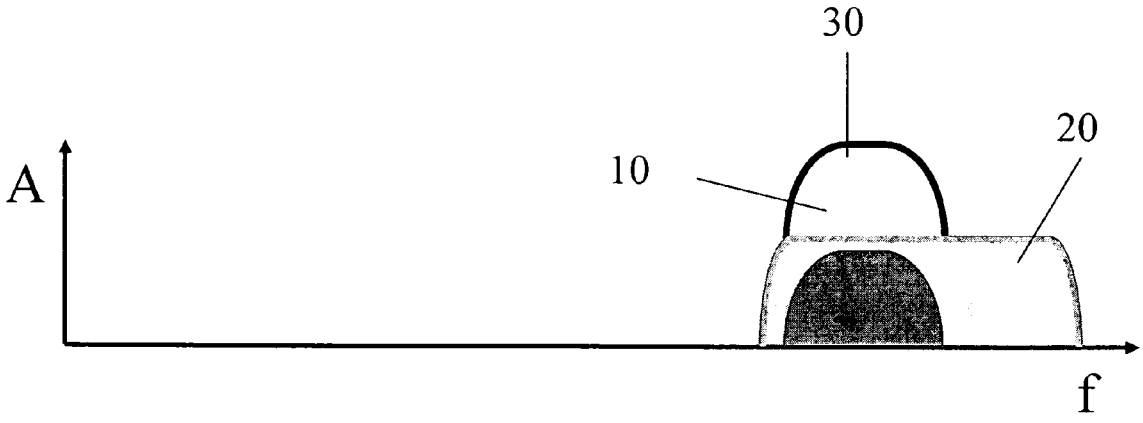
FIG. 2B is a chart showing the increased amplitude over the deficient frequency range produced by the present invention.

To clarify this process, see FIGS. 2A & 2B. The goal of a reverberation chamber exposure may be the uniform power excitation of the chamber over a single interval of frequency. In electronic mode-stirring, this leads to spatially uniform EM fields averaged over time. This mode-stirring may be accomplished using frequency sweeping or via noise modulation. FIG. 2A shows absorption region 10 contained within test frequency region 20, thus destroying the shape of the desired frequency spectrum and therefore the spatial uniformity that is desired. FIG. 2B shows that with active feedback, the amplitude over absorption region 10 can be increased as depicted in "hump" 30. Hump 30, therefore, compensates for absorption region 10, thus resulting in a power-spectrum in the reverberation chamber that is flat over the full range. Active feedback can be applied to any desired power-frequency shape. It need not be uniform in amplitude, nor cover a contiguous interval of frequency. It can be applied to electronic mode-stirring where the average EM field uniformity is achieved rapidly, as with noise-modulation, or slowly, as with frequency-sweeping. The application is RF testing of a man-made device such as a consumer electronics product, or RF treatment of an industrial material, such as a microwave heating process. Any RF exposure that desires to achieve a given frequency-uniformity in the face of unknown frequency absorption can benefit from this method, especially electronic mode-stirring which aims to achieve spatial uniformity of the microwave exposure via the frequency power-spectrum.

The implementation of this method may be via an analysis technique that is continuous in frequency and amplitude, as may be accomplished in the signal-analyzing by fitting basis functions to the result. This method may be implemented in a discrete fashion, as with the application of the well-known Fast Fourier Transform (FFT) method, or some fashion which is continuous in frequency and/or amplitude.

With the processing power of a single computer processor at the clock speeds presently used, the FFT method detects and processes the reverberation chamber power spectrum and feeds this back to the microwave frequency synthesizer every few microseconds. The processor used is preferably an Intel state-of-the-art processor. However, processors by other manufacturers will also produce desirable results.

The present invention utilizes an excitation variable that was largely ignored in the traditional electronic mode-stir. By controlling not only the noise bandwidth and amplitude about a center frequency, but also the amplitude within a sub-band inside the larger excitation bandwidth, the present invention is capable of actively maintaining the mode-structure inside the chamber even in the presence of multiple and strong frequency-dependent absorption by the DUE.

Frequency generation, as used in the present invention, may be accomplished in several manners. First, frequency generation can be achieved by balanced mixing of a modulating signal about a center frequency, if the center frequency itself is also modulated. An economical version of this technique leaves the noise modulation alone, and only changes the modulation characteristics of the center frequency. The second manner in which frequency generation occurs is through the use of quadrature mixing of a modulating signal, provided in two copies with one 90 degrees out of phase, and a center frequency in two copies, each 90-degrees out of phase. This is achieved by a new generation of off-the-shelf microwave quadrature mixers. A third manner in which frequency generation is achieved is by direct synthesis of the chamber excitation via modern digital-to-analog converters. A hybrid of these schemes is also feasible, such as the balanced mixing of two directly-synthesized signals.

The excitation of the reverberation chamber with a nominal power-spectrum preferably begins at low chamber-insertion total power. The resulting power-spectrum in the chamber is sampled and corrected by using the method of the present invention. The measurement then iterates again on the actual result inside the chamber. As the chamber power-spectrum "relaxes" to the actual power spectrum desired in the chamber, the total chamber-insertion amplifier power is incrementally raised. The active feedback continues, adapting the chamber excitation spectrum to maintain the desired resulting power-spectrum in the chamber, as a user or controlling processor continues to raise the total RF microwave power that is input into the chamber.

In this manner, the present invention obviates the weaknesses in previous techniques. The present invention uses active-feedback of the microwave excitation into the chamber to account for frequency and amplitude-dependent absorption in the contents-under-exposure of the chamber.

INDUSTRIAL APPLICABILITY

The invention is further illustrated by the following non-limiting example.

EXAMPLE

An apparatus was constructed in accordance with the present invention. The generator used was an Agilent Technologies model E6432A microwave synthesizer, combined with a Racal Instruments Model 3153 arbitrary waveform generator. The power amplifiers used are an Amplifier Research model 4000W1000 (up to 1 GHz), a model 1000T1G2B (from 1 GHz up to 2.5 GHz), a model 1000T2G8B (from 2.5 to 7.5 GHz), and a 1000T8G18B (from 7.5 to 18 GHz). The chamber used a Universal Shielding Corp. Standard Shielded Enclosure, Model USC26-101008. The sensors used are a Prodyn Technologies Model B-100 magnetic field sensor, and a model AD-70 or AD-80 electric field sensor. The processor used was an Intel Pentium processor. The apparatus was shown to have superior results in accordance with the present invention.

The preceding example can be repeated with similar success by substituting the generically or specifically described components and/or operating conditions of this invention for those used in the preceding example.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of exposing an object to uniform microwave radiation, the method comprising the steps of:

disposing an object in a chamber;

exposing the object to microwave radiation over a frequency range;

measuring a power spectrum of the microwave radiation; and modifying the amplitude of the microwave radiation at selected frequencies so that the resulting power spectrum is substantially uniform over the frequency range.

2. The method of claim 1 further comprising the step of measuring microwave absorption of the object as a function of frequency.

3. The method of claim 2 wherein the modifying step is performed to compensate for the microwave absorption of the object.

4. The method of claim 1 wherein the exposing step utilizes electronic mode-stir excitation or microwave-stirred excitation.

5. The method of claim 1 wherein the power spectrum measuring step comprises digitizing sensed signals.

6. The method of claim 1 further comprising the step of disposing one or more microwave feeds in the chamber.

7. The method of claim 6 wherein at least two of the one or more microwave feeds are orthogonally disposed.

8. The method of claim 6 wherein three microwave feeds are disposed in the chamber.

9. The method of claim 6 wherein a microwave sensor is disposed in the chamber corresponding to the direction of each of the one or more microwave feeds.

10. The method of claim 9 further comprising the step of separately processing a signal from each sensor.

11. The method of claim 1 further comprising the step of feeding the measured power spectrum back to a microwave generator.

12. The method of claim 11 wherein the measuring step comprises applying a Fast Fourier Transform to the measured power spectrum.

13. The method of claim 11 wherein the exposing, measuring, feeding, and modifying steps are repeated to form a feedback loop.

14. The method of claim 13 wherein a total chamber-insertion power is increased with each successive iteration of the feedback loop.

15. The method of claim 1 further comprising the step of controlling the amplitude of the microwave radiation within a sub-band of the frequency range.

16. The method of claim 1 further comprising the step of generating frequencies of microwave radiation using a method selected from the group consisting of balanced mixing of a modulating signal about a modulated center frequency, quadrature mixing of a modulating signal, direct signal synthesis, and a combination thereof.

* * * * *